United States Patent [19]

Waineo et al.

[11] Patent Number: 4,555,708

[45] Date of Patent: Nov. 26, 1985

[54] DIPOLE RING ARRAY ANTENNA FOR CIRCULARLY POLARIZED PATTERN

[75] Inventors: Douglas K. Waineo, Placentia; Sam S. Wong, Yorba Linda, both of Calif.

[73] Assignee: The United States of America as represented by the Secretary of the Air Force, Washington, D.C.

[21] Appl. No.: 569,642

[22] Filed: Jan. 10, 1984

[51] Int. Cl.[4] ..... H01Q 21/20; H01Q 1/28

[52] U.S. Cl. ..... 343/799; 343/DIG. 2; 343/853

[58] Field of Search ..... 343/799, 853, 800, 806, 343/DIG. 2

[56] References Cited

U.S. PATENT DOCUMENTS 4,103,304 7/1978 Burnham ..... 343/853

*Primary Examiner*—Eli Lieberman

*Attorney, Agent, or Firm*—Donald J. Singer; Bernard E. Franz

[57] ABSTRACT

A NAVSTAR satellite has a navigation antenna array beamed toward the earth. A communications antenna array for communicating with other satellites requires a pattern null near the axis and high gain to the sides with minimum losses. This is achieved with a dipole ring array comprising eight elements surrounding the navigation array. The ring has a diameter of 1.1 wavelength, and is fed with equal amplitudes and a third mode phase progression, which produces good circular polarization in the far field. For a different sized dipole ring, there will still be an optimum phase distribution which will give good circularly polarized patterns.

4 Claims, 10 Drawing Figures

DIPOLE RING ARRAY CONCEPT

DIPOLE ARRANGEMENT

STRIPLINE FEED NETWORK

EXPLODED VIEW

LAMINATED DIPOLE ASSEMBLY

DIPOLE RING ARRAY ANTENNA FOR CIRCULARLY POLARIZED PATTERN

RIGHTS OF THE GOVERNMENT

The invention described herein may be manufactured and used by or for the Government of the United States for all governmental purposes without the payment of any royalty.

BACKGROUND OF THE INVENTION

This invention relates to an antenna configuration which includes a dipole ring array for a circularly polarized shaped pattern.

Circularly polarized omnidirectional antennas with dipole arrays are known, for example for FM and TV broadcasting. U.S. Pat. No. 2,518,933 to Redheffer discloses an antenna for radiating circularly polarized waves having a fibrous material arranged in a spiral. U.S. Pat. No. 2,631,237 to Sichak et al teaches an antenna for producing circularly polarized waves comprising a first set of a plurality of coplanar elements and a second set of elements perpendicular to the first set. U.S. Pat. No. 2,639,382 to Jarvis shows an antenna including an element having a number of dipoles extending from a transmission line. U.S. Pat. No. 3,348,228 to Melancon discloses a tri-dipole antenna having a circular disc with half of each dipole on each side of the disc. U.S. Pat. No. 3,427,622 to Kandoian et al teaches a loop antenna comprising at least one loop and radially connected spokes and a central feed. U.S. Pat. No. 3,487,414 to Booker shows an omnidirectional antenna including a pair of discs with two semiannular pieces of metal foil mounted on the first disc and a plurality of radially projecting rods carried in the second disc. U.S. Pat. No. 4,083,051 to Woodward discloses a circularly-polarized antenna having a plurality of dipoles spaced in a circle about a metal mast, the dipoles being titled at an angle with respect to the plane of the circle, and the dipoles being fed in phase rotation with adjacent dipoles 90 degrees out of phase. U.S. Pat. No. 4,297,711 to Ekstrom teaches an omnidirectional antenna comprising at least one circular element including a circular metal plate with a slot and metal band. U.S. Pat. No. 4,315,264 to Du Hamel shows a circularly polarized antenna with circular arrays of slanted dipoles mounted around a conductive mast, the lengths and angles of the dipoles being adjusted for providing circularly polarized radiation.

Some satellite communication antennas require a pattern null near the axis and high gain to the sides with circular polarization and minimum losses. One example is a global positioning navigation system having several satellites and using an integrated transfer system (ITS) for data communication between satellites. A center null is desirable in the pattern to avoid potential interference from the earth. A ring array of circularly polarized elements will have the desired characteristics, but circularly polarized elements require a lot of space and have higher losses than linearly polarized elements. One prior approach to this problem, proposed by Ford Aerospace Corporation, is called a coaxial cavity resonator. This cavity radiates linear polarization, relying on phasing of the ring to suppress cross polarization.

SUMMARY OF THE INVENTION

An object of the invention is to provide an antenna configuration having a pattern null near the axis and highgain to the sides with circular polarization and minimum losses.

According to the invention, a dipole ring array of linear elements is provided with a properly optimized ring diameter and optimized circular phase distribution, such that the pattern combines in the far field to give good circular polarization. In one embodiment the dipole ring has a diameter of 1.1 wavelength and is fed with equal amplitudes and third mode phase progression (element phases equal to 1080° I/N, or three phase revolutions around the ring).

The dipole ring according to the invention is a much more attractive concept than the coaxial cavity resonator, because its weight is far less and it is much easier to integrate with the satellite and navigation antenna due to its smaller volume, lower weight, and reduced effect on the navigation antenna.

DETAILED DESCRIPTION

Figure 1:
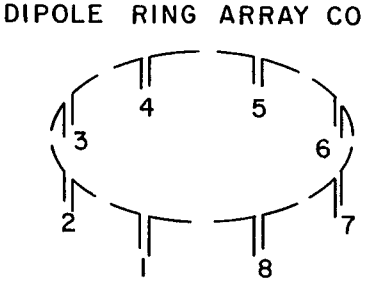
FIG. 1 is a diagramatic view showing the dipole ring array concept.
Figure 2:
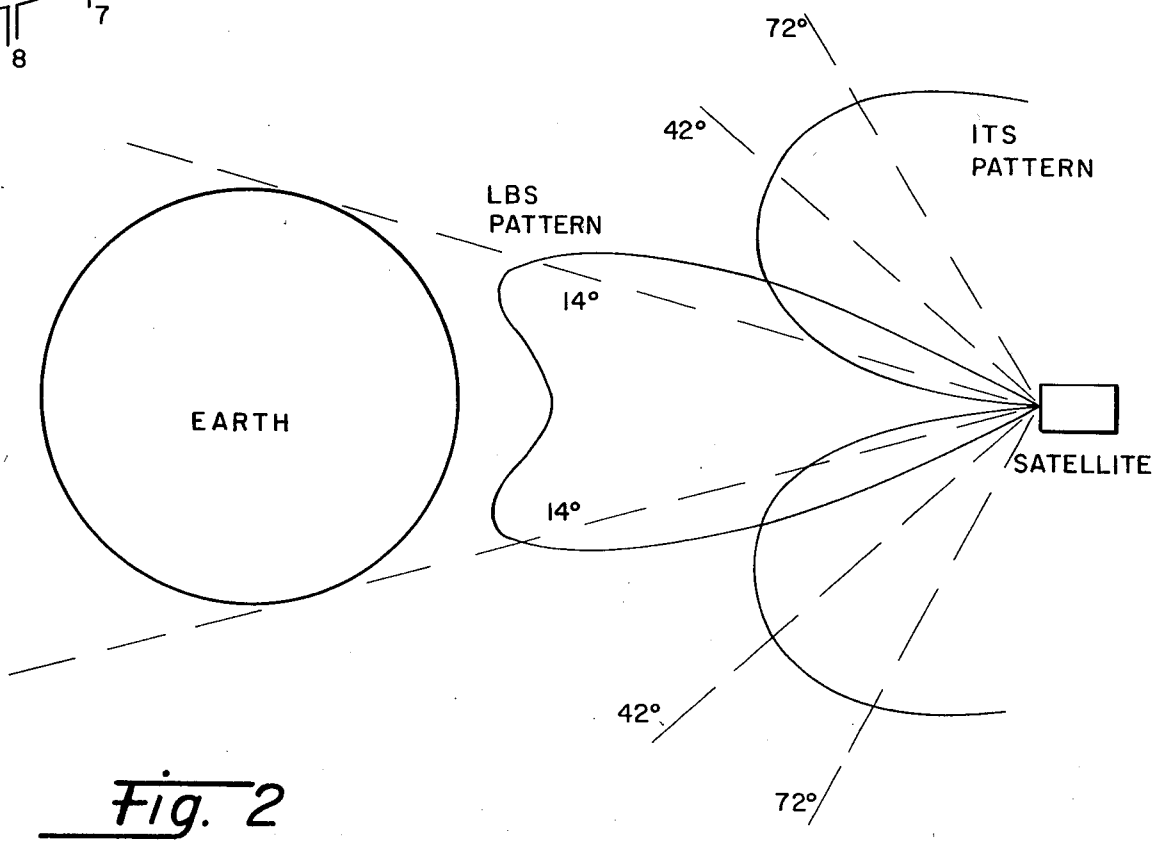
FIG. 2 is a diagram showing the desired LBS and ITS antenna patterns from a satellite with respect to the earth.

The antenna configuration is used on a satellite of a global positioning system, in which there is an LBS (L Band System) antenna array, and the dipole ring is the ITS (integrated transfer system) array for communication with other similar satellites. The LBS array comprises helical elements to transmit navigation information to points on the earth. The ITS array requires a null pattern near the axis and high gain to the sides with circular polarization and minimum losses. The desired LBS pattern and ITS patterns are shown in FIG. 2. A ring array of circularly polarized elements will have the desired characteristics, but circularly polarized elements require a lot of space and have higher losses than linearly polarized elements. However, with a properly optimized ring diameter and optimized circular phase distribution, linear elements will combine in the far field to give good circular polarization. The concept is illustrated in FIG. 1. Linear dipole elements, furthermore, are the physically smallest and simplest elements for this purpose.

Normally, such an array is fed with equal amplitude and with either equal phases or a "first mode phase progression". In the latter case each element has a phase of 360 I/N, where I is the element number and N is the total number of elements. The element phases make one revolution (360°) around the ring, hence the term "first mode". In either case, the far field polarization is primarily linear rather than the desired circular polarization. However, if the dipole ring is approximately 1.1 wavelength in diameter and is fed with equal amplitudes and a third mode phase progression (element phases equal to 1080° I/N, or three phase revolutions around the array), the array is too small in size to effectively radiate cross polarized energy and is just large enough to radiate principally polarized energy. As a result, the linearly polarized dipoles do an effective job of radiating nearly pure circular polarization in spite of the fact that each element radiates high cross polarization.

For a different sized dipole ring, there will still be an optimum phase distribution which will give good circular polarization.

For a ring diameter of D and a wavelength $\lambda$, the number of phase revolutions around the array should be approximately $\pi D/\lambda$ to cut off the cross polarized radiation. For the present case, a mode number of 3.454 would be indicated, but since such number must be an integer, 3 was chosen. The number of dipoles used for a different sized ring would be increased or decreased to maintain approximately half wave spacing between elements. This assures a smooth pattern (without gain fluctuations) in the circumferential direction.

Figure 3:
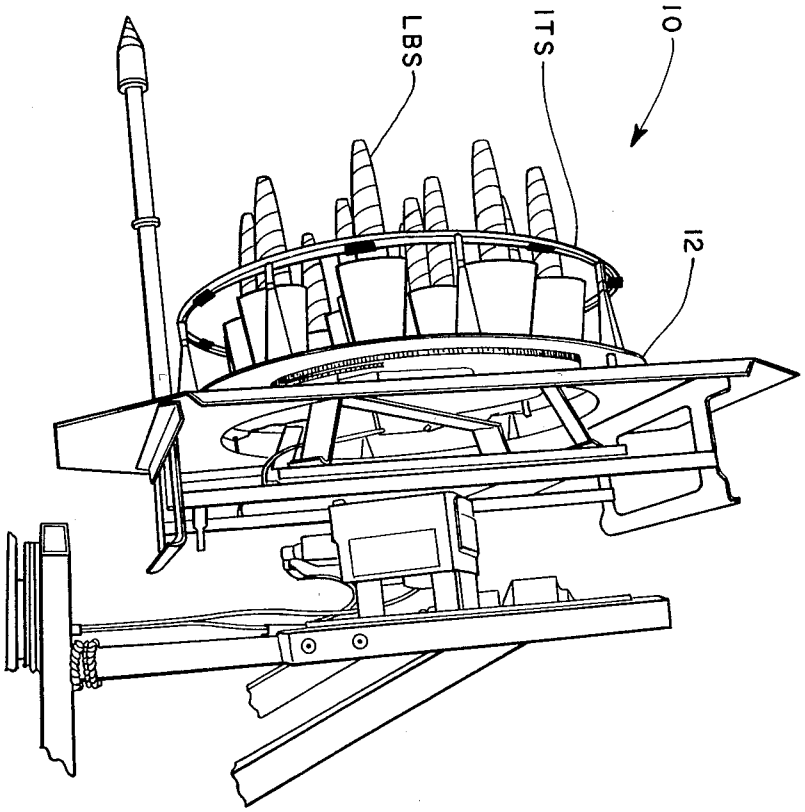
FIGS. 3, 4 and 5 are views of an LBS/ITS antenna configuration in perspective, from the side, and from the back respectively, with FIG. 5 partially broken away to show one of the dipole elements.
Figure 5:
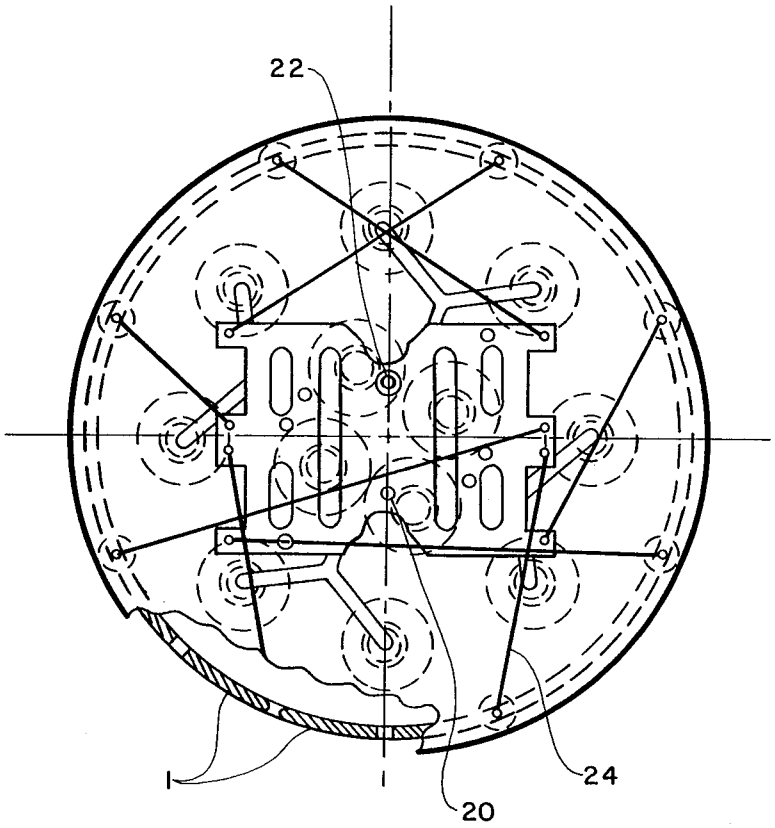
Figure 4:
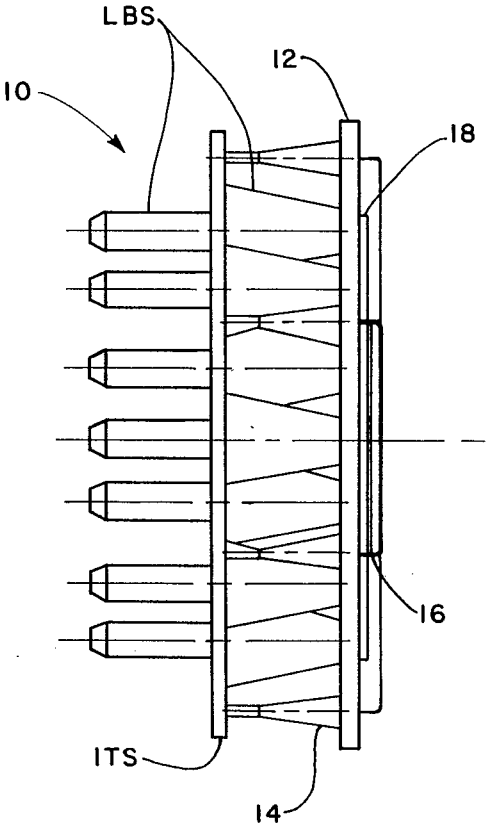
Figure 6:
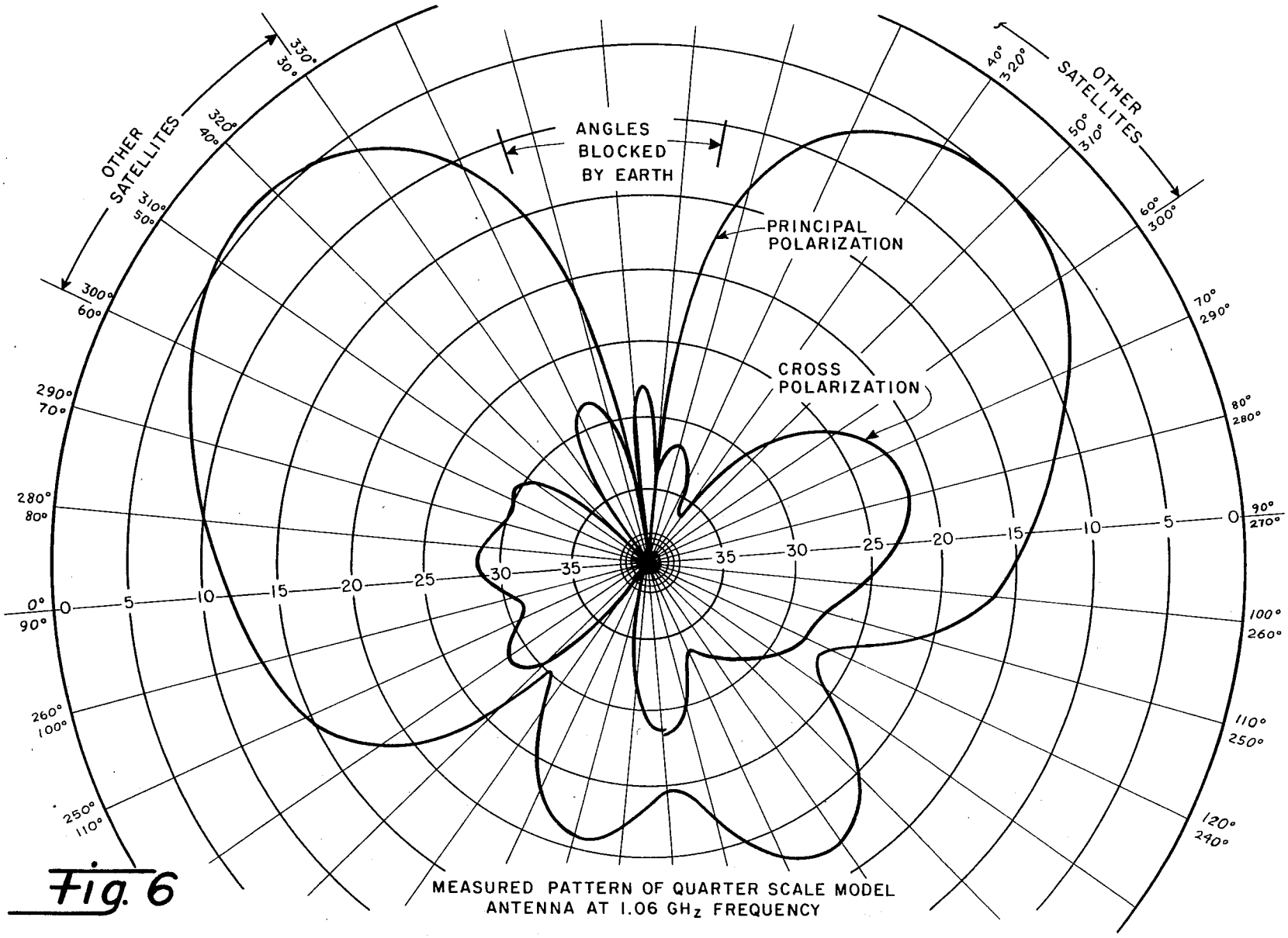
FIG. 6 is a diagram showing the measured pattern of a dipole ring array according to the invention.
Figure 7:
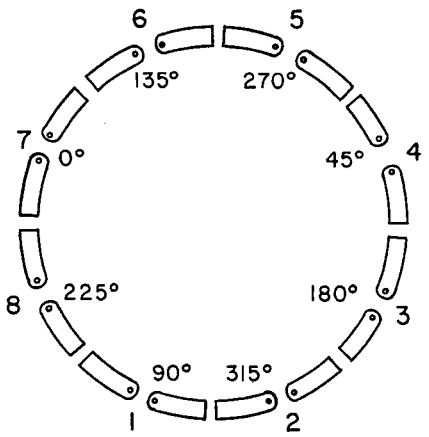
FIG. 7 is a view of the dipole arrangement showing the phasing of the eight elements.
Figure 8:
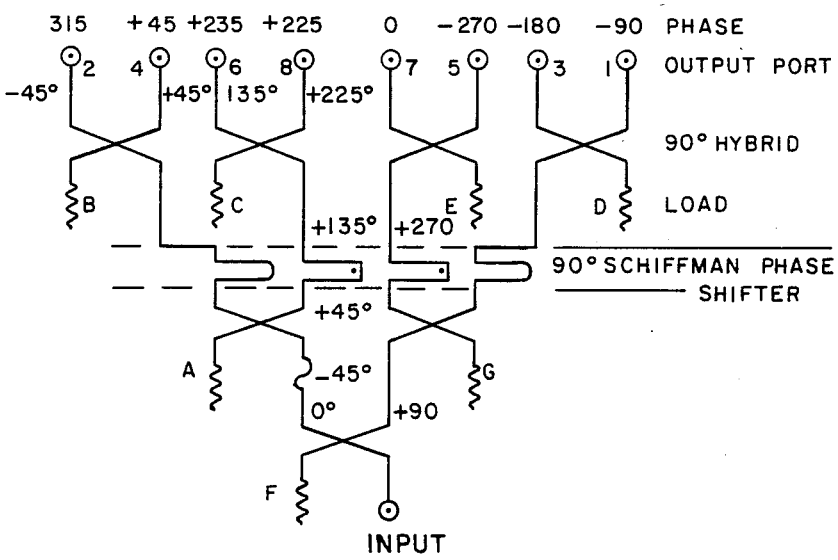
FIG. 8 is a schematic diagram of a stripline feed network to provide the phasing to the dipole arrangement as shown in FIG. 7.

The reason that the 1.1 wavelength size and 1080° I/N phase distribution was chosen is evident in FIG. 3 which shows a perspective view of a $\frac{1}{4}$ scale model of the dipole ring mounted around a scale model of the navigation antenna of the NAVSTAR satellite. FIG. 4 is a side view, and FIG. 5 is a back view showing the feed network which produces the amplitudes and phases required for the eight dipole elements. In this application, the dipole ring array supports UHF cross-link communications with other NAVSTAR Global Positioning System satellites while avoiding reception of potential interference from the earth. The 1.1 wavelength size just fits around the L-band (1200–1600 MHz) navigation antenna. A pattern of the scale model antenna is shown in FIG. 6, where the low cross polarization and good null depth over the plus and minus 14.3° earth angle is evident.

As best shown in the side view of FIG. 4, the antenna assembly 10 comprises the dipole ring ITS and the navigation antenna LBS mounted on a platform 12. The eight dipole elements 1–8 have individual supports 14. An ITS antenna feed network 16, and an LBS array feed network 18 are on the back of the assembly, shown in FIG. 5. The broken away portion of FIG. 5 shows one of the ITS antenna dipole elements 1. The ITS antenna input 20 is below the center, and the LBS array input 22 is above the center in FIG. 5. The ITS antenna coaxial cable appears at eight places, one of which is indicated by the reference character 24.

Figure 9:
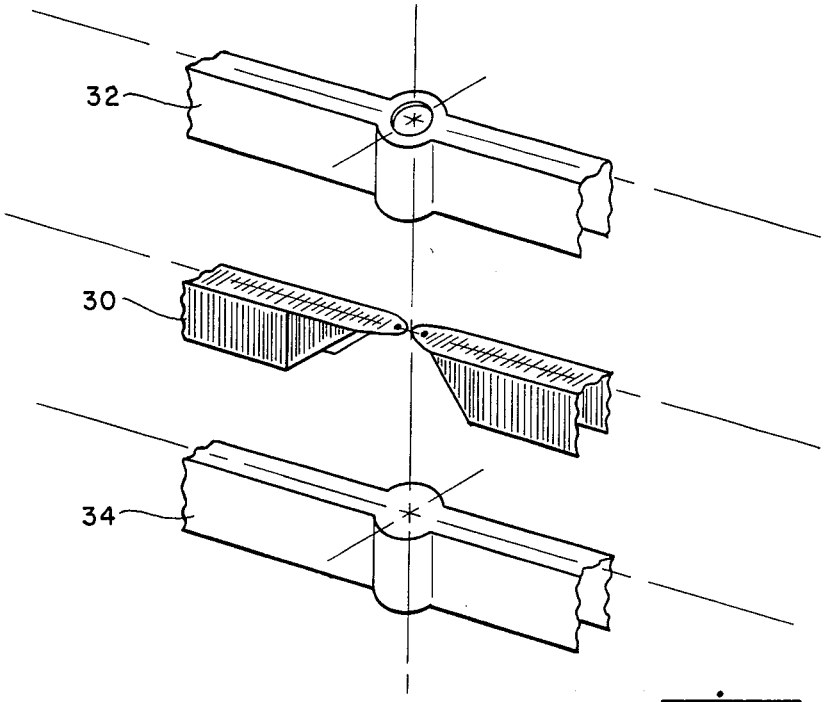
FIG. 9 is an exploded view of one dipole element with the ends broken away.
Figure 10:
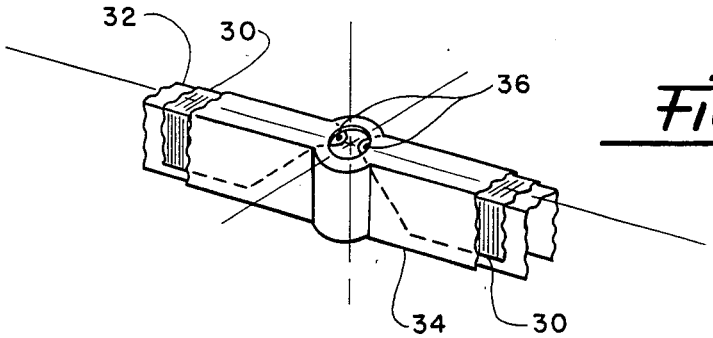
FIG. 10 is a perspective view of the laminated dipole assembly from FIG. 10.

FIGS. 9 and 10 show the construction of one dipole element. The assembly is channel or U-shaped, and comprises the copper element 30, with an epoxy/glass outer channel 32 and an epoxy/glass inner channel 34. There are solder connections 36 to the element assembly. The bottom of the channel is closed with an aluminum cup, not shown. The channel may be 2.135 inches high and 0.875 inches wide. The total length of each element from end to end may be 19.625 inches, for a UHF frequency. At the design frequency, the 1.1 wavelength diameter of the dipole ring ITS is 50 inches. To increase operating bandwidth of the antenna, dipoles may be formed with overlapping, non D-C contact, ends. The length of each element can be adjusted to "time" the element to a frequency near the low end of the operating band and a parasitic element with its length and distance from the dipole adjustable, can be tuned to a frequency near the high end of this band. The final result will be a broader bandwidth double fanned circuit design.

Thus, while preferred constructional features of the invention are embodied in the structure illustrated herein, it is to be understood that changes and variations may be made by the skilled in the art without departing from the spirit and scope of our invention.

What is claimed is:

1. In an antenna configuration for a satellite having a first array beamed toward the earth, and a second array with a null toward the earth for communication with other satellites;

wherein said second array comprises N dipole elements arranged in a ring forming a full circle, the diameter of the ring and the phase distribution to the N elements being selected to produce circular polarization in the far field, the phase to each element being P° I/N, where P is a multiple of 360° and I is the element number.

2. The apparatus according to claim 1, wherein the diameter of the ring is 1.1 wavelength, and P equals 1080°.

3. The apparatus according to claim 2, wherein N is equal to eight.

4. A dipole ring array for producing circular polarization, comprising a ring of eight elements forming a full circle, the diameter being 1.1 wavelengths and the phase distribution being selected for optimum circular polarization in the far field, the phase to each element being 1080° I/8, where I is the element number.

* * * * *